United States Patent [19]

Schlicker

[11] 4,311,239

[45] Jan. 19, 1982

[54] TELEVISION PANEL PACKAGE

[75] Inventor: Melvin C. Schlicker, Corning, N.Y.

[73] Assignee: Corning Glass Works, Corning, N.Y.

[21] Appl. No.: 142,231

[22] Filed: Apr. 21, 1980

[51] Int. Cl.[3] ..... B65D 19/00

[52] U.S. Cl. ..... 206/597; 206/600; 206/418; 206/421; 206/453; 206/454; 206/586

[58] Field of Search ..... 206/586, 597, 598, 600, 206/418, 419, 421, 453, 454

[56] References Cited

U.S. PATENT DOCUMENTS

| | | | |
|---|---|---|---|
| 1,953,627 | 4/1934 | Overholtz | 206/453 |
| 2,738,564 | 3/1956 | Guinane | 206/454 |
| 3,184,135 | 5/1965 | Johnson | 206/453 |
| 3,335,932 | 8/1967 | Brown | 206/454 |
| 3,655,034 | 4/1972 | Stollman et al. | 206/454 |
| 4,113,096 | 9/1978 | Scott | 206/586 |

FOREIGN PATENT DOCUMENTS

| | | | |
|---|---|---|---|
| 1327463 | 8/1972 | United Kingdom | 206/586 |

*Primary Examiner*—Joseph Man-Fu Moy
*Attorney, Agent, or Firm*—John P. DeLuca

[57] ABSTRACT

A support column for carrying a plurality of TV panels in a stack, wherein each column has spaced axial niches for receiving and supporting the corners of the panels therein.

16 Claims, 10 Drawing Figures

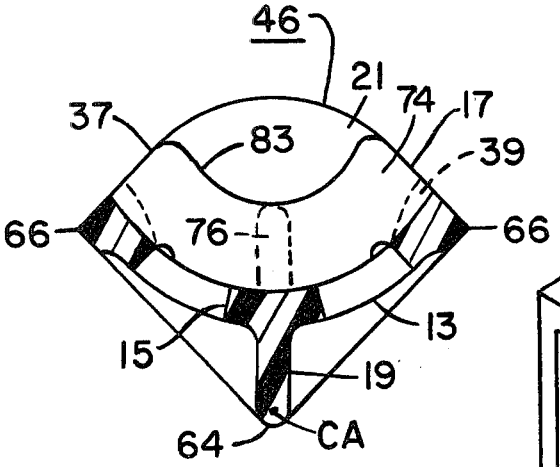
Fig. 5
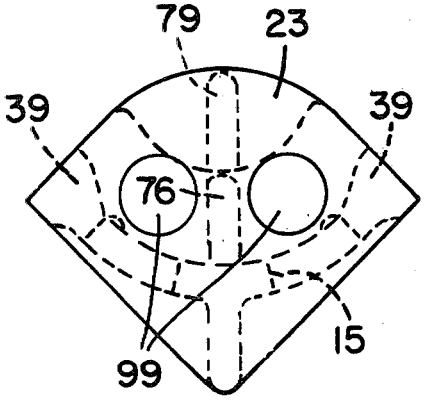
Fig. 6
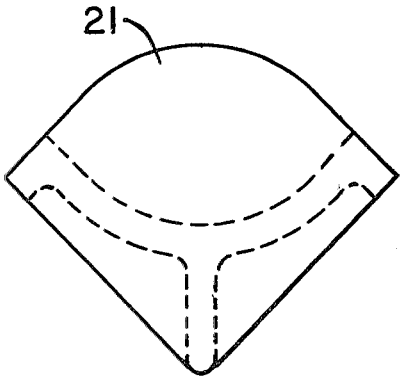
Fig. 7
Fig. 8
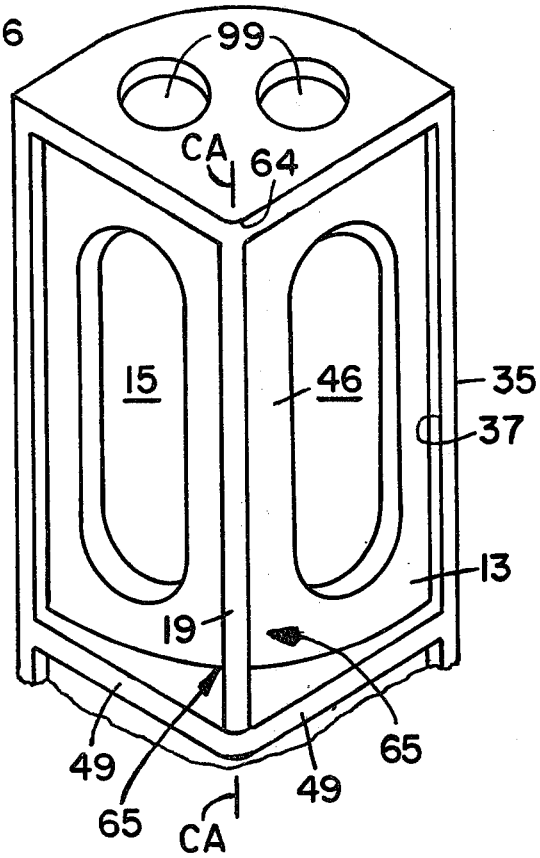
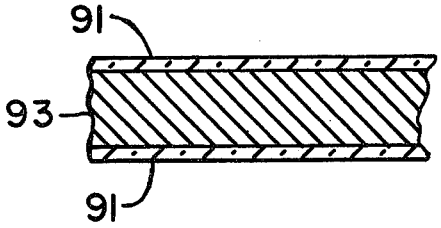
Fig. 9

TELEVISION PANEL PACKAGE

BACKGROUND OF THE INVENTION

The present invention relates to a packaging assembly for securely supporting a number of television picture tubes in stacks, such that each panel is separated from an axially spaced panel to prevent damage by abrasion or impact and wherein the columns may be bundled on a pallet assembly for shipment.

An exploded view of a prior art TV panel packaging assembly or package 10 is illustrated in FIG. 1. Pallet 12 supports the package 10 including a lower corrugated bottom portion 14, upstanding corrugated fiberboard sidewalls 16, triangular wood posts 18, a lid portion 20 and a wooden top 22. The package 10 is strapped together using various arrangements of strapping material 24. A plurality of panels 26 are arranged in stacks 27 and each panel 26 is separated from an adjacent one by a corrugated bottom spacer 28 and an upper paper separator 30. The lower separator or spacer 28 cushions each panel 26. The lowermost panel 26 in any one stack 27, carries the weight of the entire stack 27.

While this arrangement has proved to be an effective means for transporting television panels of various sizes to the tube manufacturers, it has some disadvantages. The package 10 must be manually disassembled at the tube manufacturer's loading area and all the components except for perhaps separator 30 are returned to the manufacturer of the panels at considerable cost and effort.

Another disadvantage of the described prior arrangement is that, while it is intended that the material be used many times before it must be discarded, invariably portions of the package 10 are lost or destroyed during reshipment. Further, corrugated fiberboard has the characteristic that it is effected by variations in temperature and humidity and it deteriorates to the point that even if it is returned it is sometimes unuseable.

Also, since the prior art package 10 of FIG. 1 includes a great number of component parts, the handling of the packaging material is extremely labor and inventory intensive and is not particularly suited for automation.

There are many systems in the prior art which are utilized for carrying elongated objects and packages. For example Andrus, in U.S. Pat. No. 2,256,995 shows a box having corner support members slotted for receiving oblong dish-like members. The package is not adapted for carrying heavy objects such as television panels in a vertical stack. It is essentially a conventional corrugated board support with corner inserts. Hilger in U.S. Pat. No. 3,337,468 discloses a similar arrangement for the handling of breakable sheets such as plate glass. The spacers provided are formed of corrugated members which are punched and folded to secure the glass sheets on edge within the package so that they do not deform during shipping. The packaging is, for the most part, disposable and is not adapted for the shipping arrangement herein, since there is no provision to join various packages together in a secure unit.

Combs et al. in U.S. Pat. No. 3,044,656 shows a prefabricated shipping container having components which are molded or extruded to form corners and struts of the package. This system requires a number of various types of components but does not provide for the spacing or support of the individual items within the package. It is complex to assemble and would be extremely expensive to implement. The Weiss U.S. Pat. No. 3,223,234, illustrates the concept of utilizing end supports for fragile tubes, however, each row of tubes requires a support rack therebetween adding to the number of components for the system. Peasley, in U.S. Pat. Nos. 3,302,782 and 3,334,798 shows interlocking packaging components which require assembly. Although they are adapted for protecting corners of objects, they would be difficult to implement in an automated system, or one wherein it was desired to reduce the amount of hand labor involved in producing a package. The U.S. Pats. to Swanson et al. No. 2,995,291, Maio No. 3,232,513, Graves No. 3,330,407, Lancaster et al. No. 3,867,806 and Balmer No. 3,148,773 show various packaging systems of general interest.

The present invention is adapted to reduce the number of elements necessary to produce a sturdy and reliable package for transporting fragile and heavy objects such as television tube panels and other such objects. It is important that the components used have a long service life, are sufficiently strong to provide the supporting function and are easily adapted for automation.

SUMMARY OF THE INVENTION

In a pallet assembly for securely supporting a plurality of axially spaced elongated objects in a number of columnar stacks, a support column is provided for engaging portions of each of said objects, each support column being an integrally formed quadrant portion of a cylinder having extreme portions lying in planes meeting at an axial corner and other extreme portions lying in a cylindrical surface including free ends of the planes. Said support column formed with a plurality of axially spaced niches for receiving therein the portion of the object with which it is engaged, each niche is formed radially inward of the cylindrical surface of the quadrant portion and includes a relatively flat lower support surface for receiving a complimentary portion of the object thereon in spaced relation to an axially adjacent object. A locating boss is formed within the niche for engaging an upper portion of the object to secure it against axial motion away from the support surface. Means may also be provided in the niche for spacing the object away from inner walls of the cylindrical portion.

FIG. *2a* is a schematic illustrating diagonal rigidity of the package of the present invention.

Figure 3:
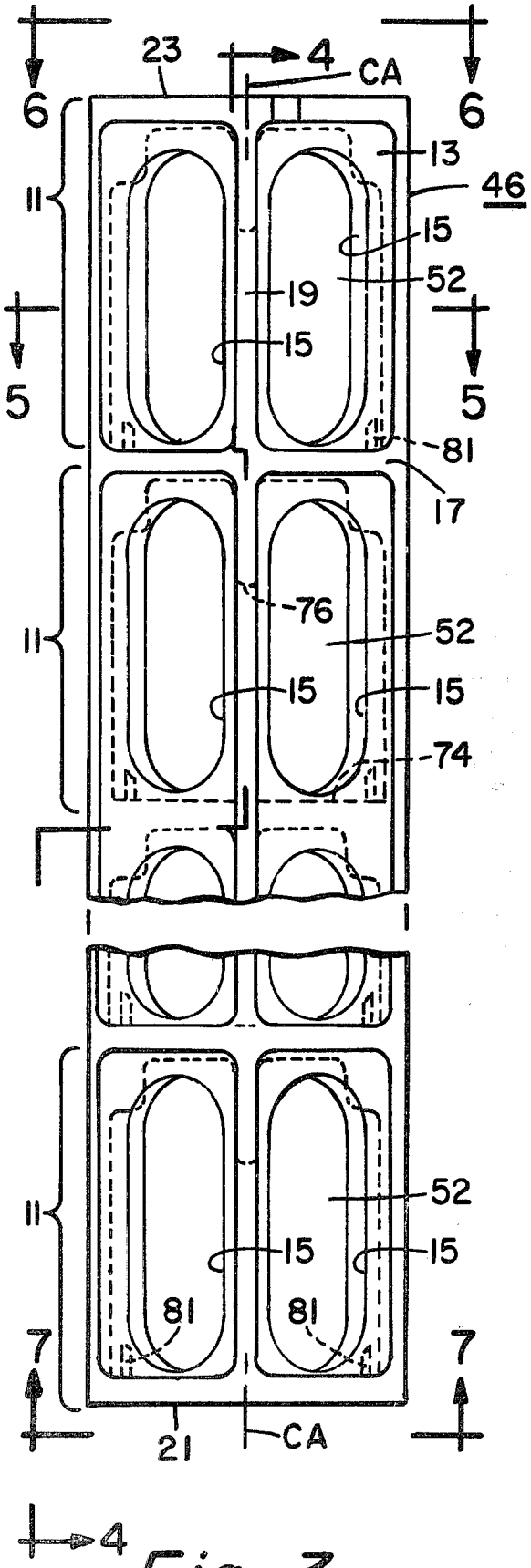

FIG. 3 is a partially fragmented back view of a support column.

Figure 4:
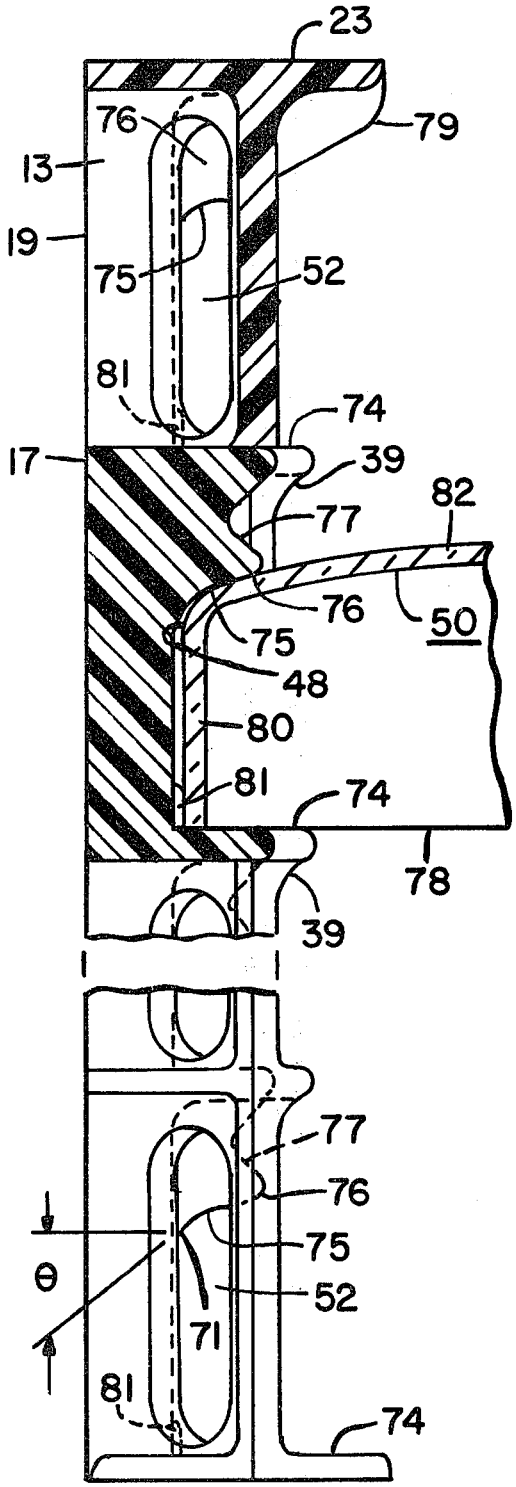

FIG. 4 is a side section of the support column taken along line 4—4 of FIG. 3.

FIG. 5 is a cross section taken along line 5—5 of FIG. 3.

FIG. 6 is a top view along line 6—6 of FIG. 3.

FIG. 7 is a bottom view taken along line 7—7 of FIG. 3.

FIG. 8 is a fragmented rear perspective of the support column.

FIG. 9 is a fragmented cross section of a wall thickness of the support column.

DESCRIPTION OF THE PREFERRED EMBODIMENTS

Figure 1:
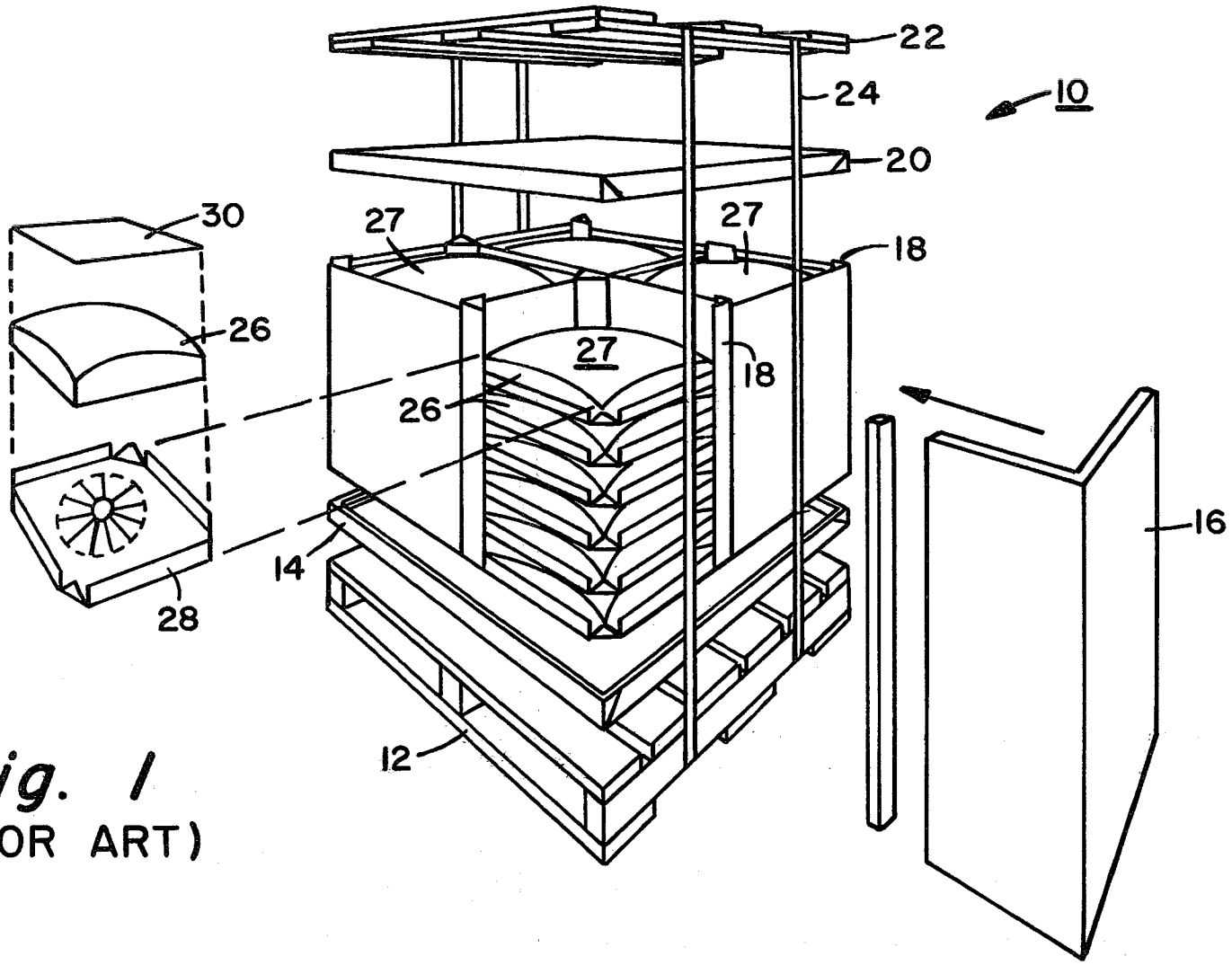
Fig. 1 (PRIOR ART)
FIG. 1 is an illustration of a prior art television panel shipping container in exploded view.
Figure 2:
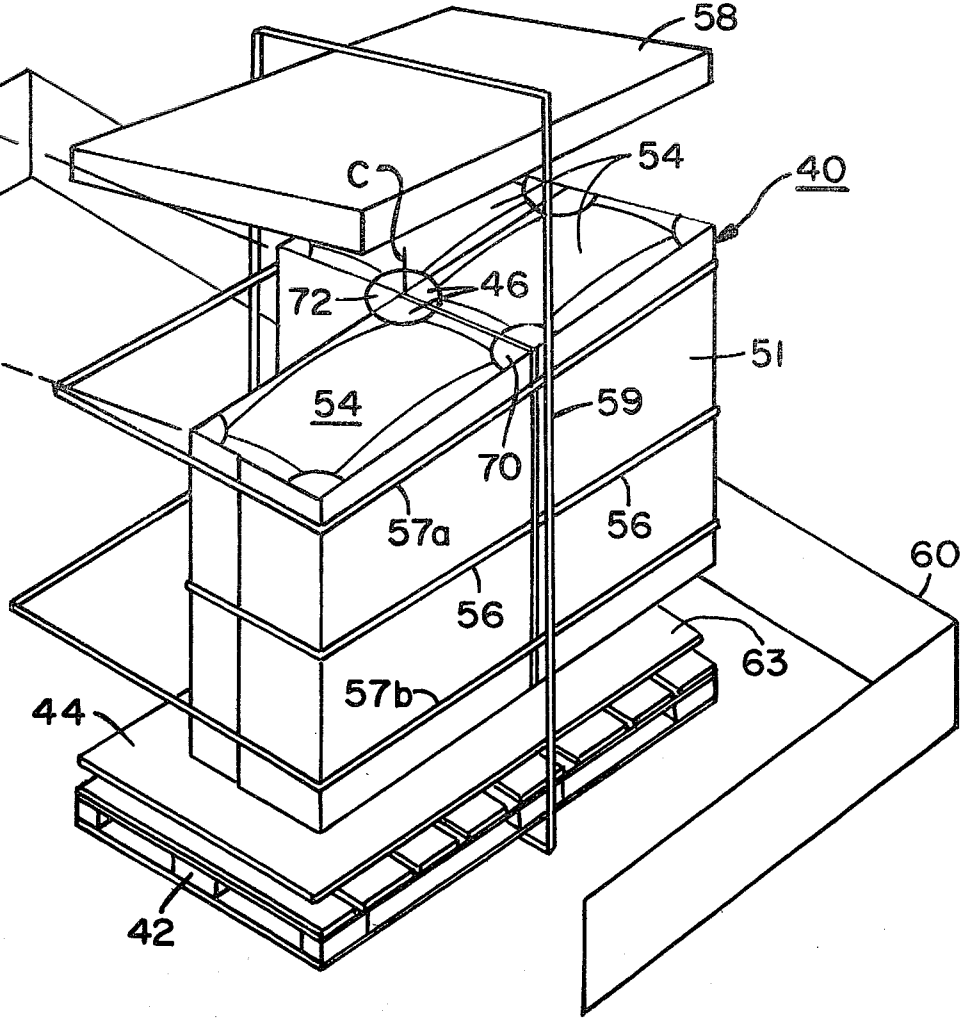
FIG. 2 is an illustration, in exploded form, of a television panel package of the present invention including a schematic of the support column.

In FIG. 2 there is illustrated a television panel package 40 constructed in accordance with the principles of the present invention. The package 40 includes a wooden pallet or base assembly 42, and a corrugated board 44 acting as a spacer and cushion over the pallet 42. A plurality of corner posts 46 are each adapted to engage respective corner portions of a plurality of television panels 50. Each corner post 46 has a plurality of niches 52 which are adapted to mate with the corners 48 of each of the panels 50. Groups of panels 50 are arranged in stacks 54 each of which may be held together by a structural wrap 51 around all four of the vertical corners of the stack and held in place by strapping 56. Structural wrap 51 also serves to protect the vertical walls of the finished package 40.

Stacks 54 are arranged on the pallet 42 in groups to form the package 40 as illustrated. In FIG. 2 four stacks 54 are arranged to form the rectangular package 40, however it should be understood that depending upon the size and arrangement of the stacks 54 a greater or lesser number thereof may be arranged on the pallet 42. A corrugated fiberboard cover 58 may be located over the package 40 to protect the panels 50. The combination of stacks 54 are secured on the pallet 42 by means of respective upper and lower horizontal straps 57*a* and 57*b* and vertical strap 59. It should be understood that a narrow band of flexible wrap 60 over a horizontal junction 63 of stacks 54 and pallet 42 could replace straps 57*b* and 59. Note: that an exterior wrap (not shown) in the form of corrugated fiberboard or full stack wrap is optional. It is not preferred because of cost consideration.

An important feature of the present invention is that each corner post 46 is an integrally formed molded member having high compressive strength for supporting the panels 50 in the stack 54. It should be realized that television panels may weigh as much as 28 pounds each, and thus the columns 46 must be adapted to maintain the panels 50 in spaced relation and support same in a secure stacked arrangement as illustrated.

The columns 46 have extreme portions lying along planar surfaces or planes 62, meeting near an axial corner 64 thereof. Free ends 66 of the planes 62 are joined along a cylindrical surface 68 which includes extremities of the column 46 lying therealong. The columns 46 thus form a quadrant of a cylinder which may be butted against one or more adjacent columns along the planar surfaces 62 to form semicylindrical forms or cylindrical forms as illustrated by respective mid-side, and central forms 70 and 72.

The niches 52 include a support surface 74 and a locking boss 76. The support surface 74 is generally flat and lies in a horizontal plane when the column 46 stands vertically, each support surface 74 is adapted to carry a lower rim portion 78 of the skirt 80 of the panel 50. Similarly, the locking boss 76 is adapted to mate with the corner portion 48 of the panel 50 along the panel face 82 and urge the panel 50 in the respective niche 52 downwardly against the support surface 74, along axis A of each panel 50, as the columns are squeezed or drawn together by the strapping 56, and stabilized by structural wrap 51.

Figure 2A:
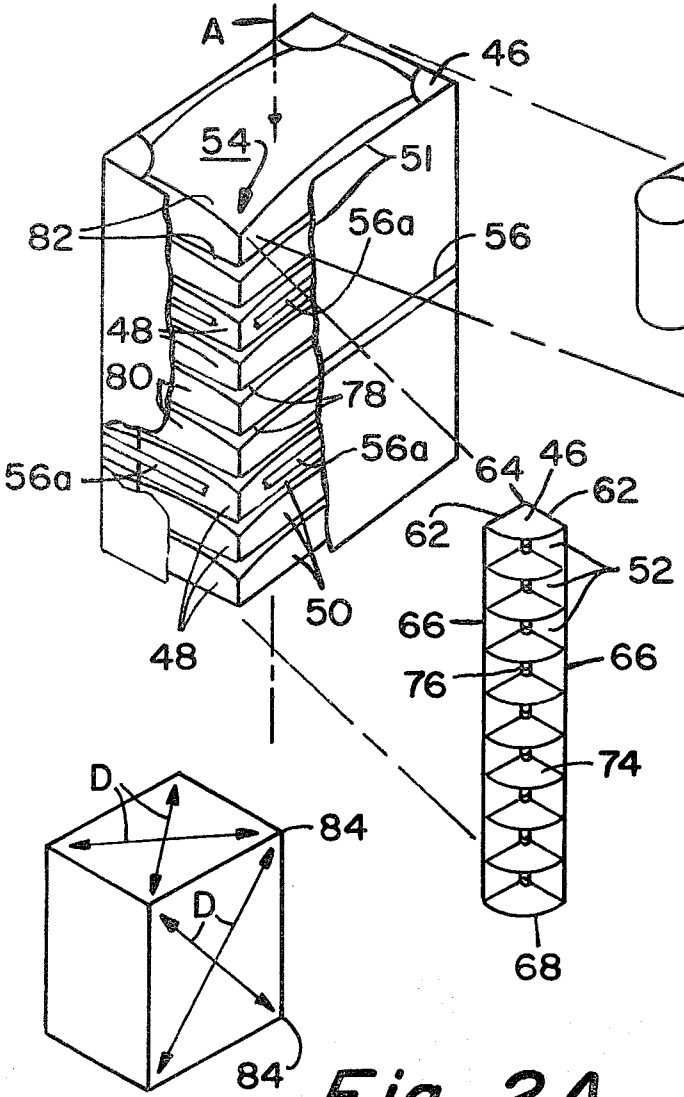

Each of the four stacks 54 are urged together towards a central axis C of the package 40 by external strapping 57*a* and 57*b*. It should be noted that the wrap 51 may be materials other than corrugated fiberboard. The final package 40, forms a rigid package having diagonals D which may be located or drawn from any one corner 84 of the package 40 to any diagonally opposite corner including a diagonal through the package 40 itself (see FIG. 2*a*). The exterior banding 57*a* and 57*b* prevents each of the stacks 54 from moving out of alignment with the vertical along axes A and C and secures them against what is commonly known as racking.

In FIGS. 3 and 4 the support column 46, sometimes hereinafter referred to as column 46, is illustrated partially fragmented in respective rear and side section views. The column 46 is divided into sections 11 each of which includes a cylindrical portion 13, and an annular portion 17. A rib 19 runs from a bottom end 21 to a top end 23 of the column 46 along column axis CA. A number of oblong openings 15 are provided to reduce weight without affecting structural strength.

Portions of the column 46 are fragmented from different perspectives (see line 4—4). In the side view of FIG. 4 it can be appreciated that each one of the sections 11 includes a niche 52, first schematically illustrated in FIG. 2. The niche 52 includes the annular portion 17 forming the floor or support surface 74 (see also FIG. 2). Similarly a projection from an inboard portion of the cylindrical portion 13 forms boss 76. Except for uppermost niche 52 an upper portion of each boss 76 is cut away at wedge cut 77 to reduce weight. Uppermost boss 76 has an exterior support rib portion 79 which provides rigidity to top portion 23.

A television panel 50, only a portion of which is shown in FIG. 4, may be located in each niche 52 with its rim 78 resting on support member 74 and its front panel 82 engaging boss 76 near the corner 48. Panel skirt 80 rests against a pair of dimples 81 projecting inwardly of niche 52 to provide two point support for the panel skirt 86 near its corner. In FIG. 4, if one imagines the column 46 being urged to the right and the panel 50 being secured in the position shown, then the boss 76 at contact point 75 with the panel face 82 urges the panel 50 downwardly against the support surface 74 and against dimples 81. From FIG. 2 it can be appreciated that, as each of the columns 46 are urged towards the central axis A of the panels 50, each of the bosses 76 will tend to lock the respective panel 50 in the niche 52.

Each boss 76 has a lower tapered contact surface 75 adapted to engage the front surface 82 of the panel 50. The angle $\theta$ that the lower surface 75 makes with the horizontal allows the columns 46 to be used for different size panels 50. For example a 25" TV panel will be dimensionally different from a 21" or 19" panel. Thus, the point of contact therebetween will be different but generally tangent to surface 75 for different panels.

It is preferred that all panels 50 in a stack 54 will be the same type. The parts necessary for the shipment of different panels 50 is greatly reduced since one column 46 can accommodate many sizes. For reasons of efficiency of packing density it is contemplated that small panels, e.g., 13", 15", 17", 19" and 21" will use one size column 46 and larger sizes will use appropriately arranged columns 46 which may be color coded to identify size and panel manufacturer.

FIG. 5 is a cross sectional view of one section 11 of the column 46 taken along line 5—5 of FIG. 3. The cross section is taken in the cylindrical portion 13 of upper section 11 and it can be appreciated that the column 46 has a unique and rigid structure. In the drawing illustrated the rib 19 forms one extreme portion of the column 46 at corner 64 near column axis CA.

Free ends 66 of the column 46 form corners 66 which extend to join with a cylindrical-like surface 37 of bottom 21 to close the figure. Side support corners 39 are formed near the free ends 66 of column 46 and join cylindrical portion 13 with next superadjacent annular portion 17 including top 23. Support surfaces 74 have circular cutouts 83 to reduce weight. Boss 76 (shown in dotted lines) is that one for the next lowest niche 52 in the drawing of FIG. 5. The cylindrical portion 13 meets the support surface 74 immediately below.

FIG. 6 is a top view of the column 46, taken along line 6—6 of FIG. 3, showing its profile with some dotted wall thicknesses. The top 23 forms an upper pad for the column 46. Similarly in FIG. 7 the bottom view taken along line 7—7 of FIG. 3 shows how the bottom 21 of the column 46 forms a solid pad upon which it can rest and remain rigid.

In FIG. 8, a rear perspective view of the present invention illustrates the location and configuration of horizontal back ribs 49 which are incorporated into the structure of the column 46 to provide rigidity and prevent a condition known as overbite. Since it is desired that the column 46 should be lightweight, unfilled areas are provided. (See arrows 65.) While these open or unfilled areas 65 may reduce weight they can allow portions of the columns 46 to mate in zones where no mating was intended. Overbite occurs when a portion of the column 46 engages or is misaligned with some freely available surface bordering an open space 65. For example the edge 35 may be aligned adjacent a similar portion of another column. However, if a twist occurs in either of the columns, outside edge 39 of one column 46 might engage with an inside edge 37 or vice versa. The same can occur in the corner 64 where one rib 19 may overlap another instead of meeting it along the column axis CA. The back ribs 49 thus help to prevent this condition by blocking snags.

It should be appreciated that one stack 54 of panels 50 may be moved in unison after removal of structural wrap 51, if it is merely strapped together by auxiliary straps 56*a* shown in FIG. 2. Appropriate apparatus may be used to temporarily support the panels while the corner supports or columns 46 are removed. Similarly, the loading of the panels 50 into a stack 54 may be accomplished automatically by means of apparatus which may be devised to engage the panels at the correct spacing while the corner posts are located and thereafter automatically strapped together into a stack. Holes 99 shown in the top 43 of column 46 (shown in FIG. 8) may be used for hook holds to move a stack 54 of panels in unison.

An important feature of the present invention is that it eliminates many of the parts necessary for the prior art packaging, namely the spacers 17, wood posts 18, the separator 28, paper 30, lid 20, bottom 14 the wooden top portion 22 and possibly the outside corrugated walls 16. While the corner posts 18 in the prior art device were included for strengthening the package 10 and protecting the corners of the panels 27, they did not support and separate the panels in the manner of the present invention. Each panel 27 in the prior package 10 rested upon the panel immediately below. Thus all of the weight of the panels 27 is carried by panels themselves. Such an arrangement could possibly produce permanent stress in the panels which could reduce picture resolution or create production difficulties.

While it is true that the package of the prior art may be sufficiently useful for safely transporting the panels 26, it should be obvious that salvage of the packing material is difficult.

In the present invention, a key portion of the package 40 is the support column 46 which, in a preferred embodiment, is a molded polymer such as a talc filled polypropylene material manufactured by FIBERITE Corp. of Winona, Minn. This is illustrated in the cross section of FIG. 9. The material forms a thin skin 91 and a foamed inner core 93. Outer skin portions 91 illustrated in hatched lines encapsulate a core 93 illustrated by the appropriate dot shaded crosshatching. The material forming column 46 may be injected into a mold where the skin and core 93 form or cure insitu. This combination provides a rigid yet lightweight structure for molding of the columns 46.

Since each support column 46 is the same as each other, the construction and assembly of the package 40 is greatly simplified and the number of different parts in inventory is greatly reduced. In FIG. 2 corner supports 46 and the pallet 42 are returned to the manufacturer of the panels 50 as are the corrugated board 44, top portion 58, and structural wrap 51, although the latter three could be made of discardable material.

The structural members are returned over again to the manufacturer for reuse. The structural wrap 51 enclosing the column 54 might be corrugated fiberboard, solid fiberboard, or a rigid plastic material with a tensile strength high enough to provide the diagonal support necessary for the package 40, all of which could be recycled. On the other hand it could be a stretch or shrink wrap material with equal tensile properties that would be discarded. Straps 56, 56*a*–57(*a*) (*b*) and 59 would most probably be discardable.

While there has been described what at present is considered to be the preferred embodiment of the present invention, it will be obvious to those skilled in the art that various changes may be made therein without departing from the invention, and it is intended in the appended claims to cover all such changes and modifications as fall within the true spirit and scope of the invention.

I claim:

1. A support column for securely supporting a plurality of objects in a column wherein said support column comprises an integrally formed rigid quadrant portion of a cylinder having adjoining sides meeting at an axial corner and free ends thereof terminating at a selected radial distance from said corner, and a cylindrical surface joining the free ends of the adjoining sides, said support column formed with a plurality of axial spaced niches for receiving therein a corner portion of an object to be supported, each niche is formed radially inwardly of the cylindrical surface of the quadrant portion and includes a lower support surface for receiving thereon a corresponding lower part of said corner portion of the object disposed in said niche in spaced relation to an axial adjacent one of said objects, and a locating boss located in opposition to the lower support surface for axially engaging a corresponding upper part of the corner portion of the object in opposition to the said lower part for securing said object axially against said lower support surface upon application of a radial force of the object against the column.

2. The support column of claim 1 wherein said column is formed into a composite laminate having a foamlike inner core and a skin-like outer layer forming a rigid member.

3. The support column of claim 2 wherein the outer layer and core are injection molded and formed in situ.

4. The support column of claim 1 wherein said niches include cylindrical upstanding walls complementary to the corner portion of the object and a relatively flat annular portion forming the lower support surface joined with said upstanding cylindrical wall, the cylindrical wall portion extending to the next succeeding annular portion.

5. The support column of claim 4 wherein the boss has a working surface lying at an acute angle relative to the lower support surface and being generally tangent to at least one point on an opposed face of the object near the corner portion thereof for urging said object against the support surface.

6. The support column of claim 4 wherein the cylindrical wall has openings thereon for reducing the column weight.

7. The support column of claim 5 wherein an inner portion of the cylindrical surface portion includes protrusions extending into each niche for engagement with the panel object.

8. The support column of claim 1 wherein respective lowermost and uppermost annular portions form a bottom and top of the column and the top portion has at least one hole therein for an inboard portion forming a hook catch.

9. The support column of claim 1 including means for the adjoining sides for inhibiting overbite of one support column and another when juxtaposed along the adjoining sides.

10. A package assembly for securely supporting a plurality of axial spaced rectangular TV picture tube panels in a plurality of columnar stacks on a pallet forming a base support for the stacks the package assembly comprising a support column for each of four corners of each stack of panels, each support column being an integrally formed rigid quadrant portion of a cylinder having adjoining sides lying in planes meeting near an axial corner and free ends of said sides terminating at a selected radial distance from said corner and a cylindrical surface joining the free ends of the adjoining sides, said support column formed with the plurality of axially spaced niches for receiving therein one of each of the four corners of a panel, each niche formed radially inwardly of the cylindrical surface of the quadrant portion and including a relatively lower support surface for receiving a lower rim portion of the panel thereon in spaced relation to an axial adjacent one, and a locating boss for engaging an opposed upper face portion of the panel for urging the panel axially against the support surface upon application of a radial force against the panel and support column, the stacks being located on said pallet in a rectangularly arranged group of stacks; securing means circumferentially located about each stack and group of stacks and the pallet for securing the package into a unitary rigid structure.

11. The package assembly of claim 10 wherein said securing means includes strapping circumferential of each stack and groups of stacks.

12. The package assembly of claim 11 wherein said securing means further includes a structural wrapper circumferentially disposed about each stack extending substantially the entire length thereof, said wrapper being relatively nondeformable along diagonals of the stack and for stabilizing the group stacks into a unitized diagonally stable package when secured together.

13. The package assembly of claim 12 wherein said structural wrapper includes at least one of a folded semirigid board panel adapted to be circumferentially located about each stack and an organic film stretch wrap polymer about the group of stacks.

14. The package assembly of claim 10 further including, means located in the adjoining sides of the support column for stabilizing the rigidity of the column and inhibiting overbite of one support column adjacent another.

15. The package assembly of claim 13 including, means for securing the stacks of panels to the pallet.

16. The package assembly of claim 15 wherein said means for securing the stacks to the pallet includes a lower portion of the stretch film wrap polymer bridging a lower portion of the stack with the pallet.

* * * * *